US005101776A

United States Patent [19]

Ma

[11] Patent Number: 5,101,776

[45] Date of Patent: Apr. 7, 1992

[54] ENGINE WITH VARIABLE COMPRESSION RATIO

[75] Inventor: Thomas T. Ma, Chelmsford, Great Britain

[73] Assignee: Ford Motor Company, Dearborn, Mich.

[21] Appl. No.: 669,416

[22] PCT Filed: Sep. 19, 1989

[86] PCT No.: PCT/GB89/01098

§ 371 Date: Mar. 11, 1991

§ 102(e) Date: Mar. 11, 1991

[87] PCT Pub. No.: WO90/03507

PCT Pub. Date: Apr. 5, 1990

[30] Foreign Application Priority Data

Sep. 24, 1988 [GB] United Kingdom ..... 8822498

[51] Int. Cl.[5] ..... F02B 75/04

[52] U.S. Cl. ..... 123/48 D; 123/78 D

[58] Field of Search ..... 123/48 R, 48 D, 78 D

[56] References Cited

U.S. PATENT DOCUMENTS

| | | | |
|---|---|---|---|
| 1,983,351 | 12/1934 | Edwards | 123/78 D |
| 1,994,000 | 3/1935 | Lang | 123/48 D |
| 2,042,969 | 6/1936 | Snyder | 123/48 D |
| 2,890,688 | 6/1959 | Goiot . | |

FOREIGN PATENT DOCUMENTS

| | | | |
|---|---|---|---|
| 428506 | 6/1934 | United Kingdom | 123/48 D |
| 715274 | 9/1954 | United Kingdom | 123/48 D |

*Primary Examiner*—David A. Okonsky
*Attorney, Agent, or Firm*—Jerome R. Drouillard; Clifford L. Sadler

[57] ABSTRACT

An internal combustion engine is described in which each combustion chamber (10) in the engine has an associated auxiliary chamber (18), and in which, for low compression ratio operation, the auxiliary chamber (18) is constantly connected to the combustion chamber (10) and, for high compression ratio operation, the auxiliary chamber (18) is connected to the combustion chamber (10) by a one way valve (24, 36, 38, 40) which permits gas flow only in the direction from the combustion chamber (10) towards the auxiliary chamber (18).

7 Claims, 1 Drawing Sheet

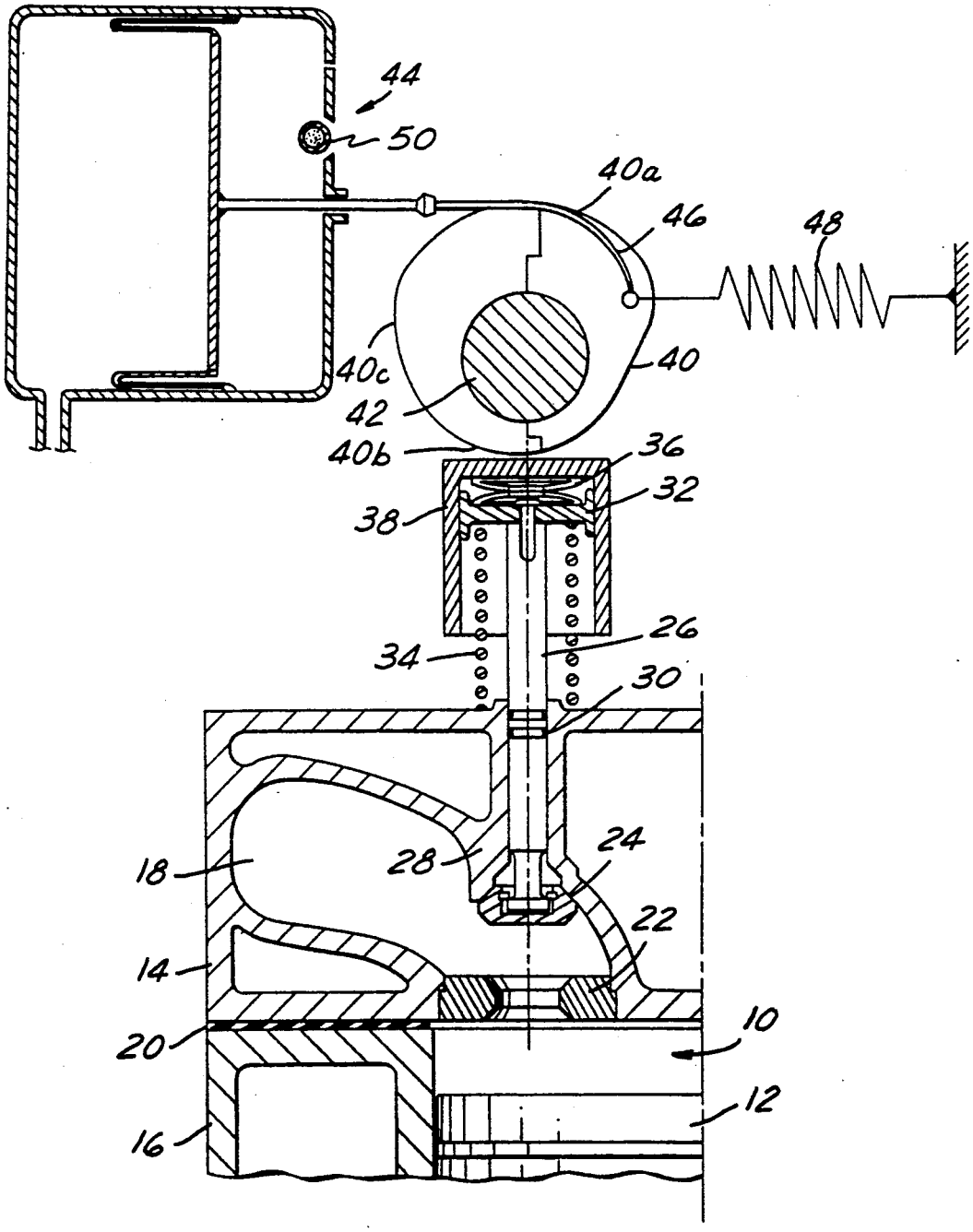
44
50
40a
46
48
40c
40
42
40b
36
32
38
26
34
30
18
28
24
22
14
10
20
12
16

ENGINE WITH VARIABLE COMPRESSION RATIO

The invention relates to an engine in which the compression ratio is variable.

It is well known that the selection of compression ratio is a design compromise in any engine with fixed compression ratio. In particular, the efficiency under part load operation is improved by increasing the compression ratio but a high compression ratio cannot be used under high load conditions because of the tendency for the engine to knock on account of the high temperatures and pressures occurring in the combustion chamber. In view of the damage caused to the engine by knock under high load conditions, the compression ratio in an engine of fixed compression ratio is limited to the lowest safe value for high load operation, which leads to a corresponding sacrifice in efficiency under part load operation. Any conventional engine can thus be rendered more efficient if the compression ratio is increased only during part load operation.

It is particularly desirable to be able to vary the effective compression ratio in engines in which late or early inlet valve closing is used as a means of regulating the intake charge to achieve part load operation. Such regulation is done to reduce pumping losses in the engine but has the adverse effect of reducing the effective compression ratio even further during part load operation.

Various suggestions for varying the compression ratio are to be found in the prior art. These proposals are intended to vary the geometry of combustion chamber or the cranking mechanism while the engine is running. To date, none of these suggestions has been commercially feasible for a variety of reasons, amongst them cost, complexity, reliability and bulk.

GB-A-2,122,251 proposes an auxiliary chamber connected to the main combustion chamber by a valve which is opened at a variable instant in the compression stroke. The valve in this proposal needs to be actuated during each engine combustion cycle and is intended to remove part of the charge from the combustion, reintroducing that part of the charge into the next combustion cycle.

U.S. Pat. No. 3,889,646 describes a variable compression ratio cylinder head in which an auxiliary volume is connected to the main combustion chamber by a conventional poppet valve. Such an arrangement is not practicable because during low compression operation, that is under high load, the valve stem and head (which are poorly cooled) are fully exposed to the elevated temperatures within the combustion chamber and will cause pre-ignition. The valve will also not seal the combustion chamber effectively during such low compression operation because of leakage through the valve guide. For these reasons, the proposal in the above patent is intended only to facilitate the starting of a high compression ratio engine and once started, the auxiliary volume is permanently isolated from the combustion chamber.

A still further proposal, described in JP-A-60-27742, includes a rotor in the cylinder head which has a cut away portion to increase the residual volume when in one position. A serious problem with this, and other proposals relying on rotary valves, is that sealing around the rotor is not adequate. The increased clearance gap is a source of hydrocarbon emissions and furthermore deposits in this gap around the rotor eventually interfere with its operation.

GB-A-715,274 and other prior art patents, propose an auxiliary chamber connected to the combustion chamber permanently during low compression ratio operation and isolated from the combustion chamber during high compression ratio operation by a valve which tends to be raised off its seat by the combustion pressure. In such an engine, it is necessary to provide a valve which can effectively seal the two chambers from one another against this high pressure and for this a large external force is required. Also, once the valve is seated, the auxiliary chamber takes no further part in the engine operation and the chamber is vented to atmosphere either intentionally or by taking no special provisions to seal the stem of the valve.

According to the present invention, there is provided a variable compression internal combustion engine having a combustion chamber and an associated auxiliary chamber, in which, during low compression ratio operation, the auxiliary chamber is constantly connected to the combustion chamber and, during high compression ratio operation, the auxiliary chamber is isolated from the combustion chamber, characterised in that the auxiliary chamber is a sealed chamber, isolated from the ambient atmosphere, and in that a one-way valve is arranged between the two chambers during high compression operation, which valve permits gas flow only in the direction from the combustion chamber towards the auxiliary chamber, whereby upon initial movement of the valve into the high compression ratio position, gas flow takes place into the auxiliary chamber until the pressure in the auxiliary chamber substantially equals the maximum pressure in the combustion chamber, the pressure in the auxiliary chamber thereafter assisting in maintaining the valve closed.

In a preferred embodiment of the invention, the auxiliary chamber is connected to the combustion chamber by a passage containing a poppet valve, the poppet valve being urged towards its valve seat by a cam and a spring which acts on the poppet valve in the opposite direction to the pressure in the combustion chamber.

When retracted from its seat, the poppet valve allows gas to flow freely between the combustion chamber and the auxiliary chamber, in both directions. On the other hand, when resting on its seat, the valve can still be raised off its seat if the pressure difference across it exceeds the force of the biassing spring and therefore acts as a one way valve permitting flow from the combustion chamber towards the auxiliary chamber.

In operation, the valve is fully retracted for low compression ratio operation and effectively increases the residual volume in the combustion chamber. On the other hand, the valve is constantly closed when it is desired to set a high compression ratio. In this case, in the first few operating cycles, some gas will pass into the auxiliary chamber and incrementally raise the auxiliary chamber pressure. However, once the auxiliary chamber attains approximately the maximum pressure that can be reached in the combustion chamber then no further gas flow will occur in either direction until the valve is again opened to set the lower compression ratio.

The engine can thus be run at either of two compression ratios and in neither setting does the valve need to be operated cyclically. The control mechanism for the valve may therefore be of simple construction and will not require a high force to operate it as the pressure necessary to maintain the valve closed during high compression ratio operation is derived from the pressure in the combustion chamber.

The poppet valve is preferably formed with two valve sealing surfaces, the first for isolating the combustion chamber from the auxiliary chamber, and the second for isolating the auxiliary chamber from atmosphere when the valve is retracted.

Conveniently, the valve is operated by a cam which is rotatable about its axis, between two limit positions, by means of a suitable actuator, such as a vacuum motor or a solenoid.

Advantageously, the poppet valve is acted upon by two springs, the first urging the valve towards the cam and the second being a shorter spring which is compressed between the valve stem and the cam when the valve acts as a spring biased non-return valve.

The auxiliary chamber may be formed in much the same way as a port but which has a closed end to form a sealed chamber. Indeed an engine can be formed by modification of a four valves per cylinder engine in that one of the exhaust ports can be blanked off to form the required auxiliary chamber and the valve for setting the compression ratio can be substituted for the corresponding exhaust valve. The cam for the valve may then be journalled on the exhaust camshaft in place of the corresponding exhaust cam.

The invention will now be described further, by way of example, with reference to the accompanying drawing is a schematic section through a part of a combustion chamber of an internal combustion engine in accordance with the invention.

The combustion chamber in the drawing generally resembles that of an engine having two exhaust valves per cylinder. However, the engine has only one exhaust port leading to an exhaust passage and the other is closed off and acts instead as an auxiliary chamber to enable the compression ratio to be varied. The drawing shows only the details of the auxiliary chamber.

A main combustion chamber 10 is bounded by a piston 12, a cylinder head 14 and a cylinder block 16. A gasket 20 effects a seal between the cylinder head 14 and the cylinder block 16. A spark plug, an exhaust port and one or more inlet ports are provided in the usual manner but are not shown in the drawing.

An auxiliary chamber 18 is connected to the main combustion chamber 10 and a valve seat 22 for a poppet valve 24 is disposed between the combustion chamber 10 and the auxiliary chamber 18. Unlike the arrangement of a conventional poppet valve in a cylinder head, compression and combustion pressures on the head of the poppet valve 24 act to lift the valve 24 off its seat 22.

The poppet valve 24 has two sealing surfaces on the opposite sides of its skirt. In the illustrated position, the valve seals against its guide 28 and isolates the auxiliary chamber 18 from atmosphere.

In its other end position, the valve 24 abuts the valve seat 22 to isolate the auxiliary chamber 18 from the main combustion chamber 10 and 0-rings 30 placed around the valve stem 26 within the valve guide 28 serve to isolate the auxiliary chamber from atmosphere.

The stem 26 extends beyond the cylinder head 14 for actuation by means of a cam 40, which is constructed as a split cam free journalled for rotation about the exhaust cam shaft 42. The end of the stem 26 carries an abutment plate 32 which is bolted onto the valve stem 26. From below, the plate 32 is acted upon by a long weak spring 34 and from above the abutment plate is acted upon by a shorter spring 36 sandwiched between the end plate 32 and a bucket cam follower 38.

The cam profile consists of two dwell sections **40*a* and 40*b*, each being of generally constant radius, connected to one another by a ramp section 40*c*. The cam does not in fact rotate through a full circle and the right side of the cam, as viewed, does not come into contact with the bucket 38** at any time.

In the illustrated position, the spring 34 is acting to seat the valve 24 against a seat formed at the lower end of the valve guide 28. The spring 36 is not compressed and the valve guide is sealed so that the entire valve stem 26 is isolated from the combustion taking place in the main chamber 10 and the auxiliary chamber 18. This low compression ratio operation can therefore safely be used under high load conditions, without risk of preignition and consequent damage to the engine.

Under part load conditions, the cam 40 is turned anti-clockwise as viewed by a suitable actuator, which in the illustrated embodiment is a vacuum motor 44 connected to the cam 40 by a cable 46. The vacuum motor acts against the force of a return spring 48 which biases the cam 40 clock-wise, as viewed. The vacuum motor which incorporates a one way damping valve 50 to enable rapid movement of the valve into the high compression position but slow return to the low compression position.

The force exerted by the vacuum motor on the cam is not sufficient to overcome the upward pressure forces on the valve 24 during the compression and combustion strokes of the cycle. Movement of the cam is therefore resisted until the next exhaust and intake strokes. Energy is stored in the vacuum, which acts as a spring pre-loading the cam until such time as it can move the valve. If an electric actuator (such as a solenoid) is employed, then it is possible either to synchronise its energisation with the exhaust/intake strokes or to include a force reservoir, such as a spring, between the actuator and the cam 40. In all cases, the force required to change the compression ratio is minimal. Rotation of the cam 40 anti-clockwise by the vacuum motor 44 during the exhaust stroke will align the dwell section **40*a* with the bucket 38 urging the valve 24 towards the valve seat 22 and retaining it within a short distance from the seat 22. In this position, the spring 36 will be compressed to urge the valve 24 against its seat but compression and combustion pressures can still lift the valve off its seat to a small extent, limited by the cam 40. The valve 24 therefore now acts as a non-return valve permitting flow from the main combustion chamber 10 to the auxiliary chamber 18**.

It is desired for high compression ratio operation to isolate the auxiliary chamber 18 from the main chamber 10 and though this will not occur immediately, any flow of gases out of the main combustion chamber, being unidirectional, will steadily increment the pressure in the auxiliary chamber until the one-way valve will cease to open, thus effectively isolating the two chambers from one another permanently.

It is important that the valve 24 should seal properly against its seat 22. Such sealing is however difficult to ensure because the alignment of the valve stem with the axis of the seat cannot be guaranteed to the required degree of accuracy within normal manufacturing tolerances. To mitigate this problem, the valve is formed with a head which is separate from its stem and retained by a circlip. Such construction affords the head sufficient lost motion to permit it to centre itself on the valve seat despite any small misalignment. This construction also offers the important advantage that the part of the valve 24 which effect a seal is effectively acted upon over its entire area by the pressure in the auxiliary chamber and one need not make any allowance for the differential area on the opposite sides of the valve head.

The illustrated embodiment is intended for assembly from the under-side of the cylinder and this is preferred as a valve 24 with a large head can then be employed. It is however alternatively possible, if a smaller valve seat is used, to introduce a valve and valve guide subassembly into the cylinder head from above. The problem encountered in such a construction is that the size of the valve seat 22 cannot be reduced at will but must be sufficiently large not to interfere with flame propagation between the chambers 10 and 18.

The pressure in the auxiliary chamber 18 acting on the valve seat insert 22 during high compression operation acts in a direction to dislodge the insert. It is therefore important to ensure a firm coupling between the insert and the cylinder head. If desired, the rim of the insert may overlap the cylinder block to ensure that it cannot drop into the combustion chamber under any circumstances.

Recent research on the effect of the presence of an auxiliary chamber connected by a relatively narrow passage with a main chamber on the combustion process suggests that a resonance effect between the two chambers may take place. If such process does occur between the auxiliary chamber and the main chamber in the present invention during full load operation, then it may have the desirable effect of improving the efficiency of combustion and reducing the tendency to knock.

What is claimed is:

1. A variable compression internal combustion engine having a combustion chamber (10) and an associated auxiliary chamber (18), in which, during low compression ratio operation, the auxiliary chamber (18) is constantly connected to the combustion chamber (10) and, during high compression ratio operation, the auxiliary chamber (18) is isolated from the combustion chamber (10), characterised in that the auxiliary chamber (18) is a sealed chamber, isolated from the ambient atmosphere, and in that a one-way valve (22,24) is arranged between the two chambers (10,18) during high compression operation, which valve (22,24) permits gas flow only in the direction from the combustion chamber (10) towards the auxiliary chamber (18), whereby upon initial movement of the valve into the high compression ratio position, gas flow takes place into the auxiliary chamber (18) until the pressure in the auxiliary chamber (18) substantially equals the maximum pressure in the combustion chamber (10), the pressure in the auxiliary chamber (18) thereafter assisting in maintaining the valve closed.

2. An internal combustion engine as claimed in claim 1, wherein the auxiliary chamber (18) is connected to the combustion chamber (10) by a passage containing a poppet valve (24), the poppet valve (24) being urged towards its valve seat by a cam (40) and a spring which (36) acts on the poppet valve (24) in the opposite direction to the pressure in the combustion chamber (10).

3. An internal combustion engine as claimed in claim 2, wherein the poppet valve (24) is formed with two valve sealing surfaces, the first for isolating the combustion chamber (10) from the auxiliary chamber (18) when the valve is in the high compression ratio position, and the second for isolating the auxiliary chamber (18) from atmosphere when the valve is in the low compression ratio position.

4. An internal combustion engine as claimed in claim 3, wherein sealing rings (30) are arranged around the stem (26) of the poppet valve (24) to isolate the auxiliary chamber (18) from the ambient atmosphere when the valve (24) is in the high compression ratio position.

5. An internal combustion engine as claimed in claim 3 wherein the valve (24) is operated by a cam (40) which is rotatable about its axis, between two limit positions, by means of a suitable actuator (44).

6. An internal combustion engine as claimed in claim 5, wherein the actuator is a vacuum motor (44).

7. An internal combustion engine as claimed in claim 2 wherein the poppet valve (24) is acted upon by two springs, the first (34) urging the valve towards the cam and the second (36) being a shorter spring which is compressed between the valve stem and the cam (40) when the valve acts as a spring biased non-return valve.

* * * * *